United States Patent [19]

Kume et al.

[11] Patent Number: 4,838,847

[45] Date of Patent: Jun. 13, 1989

[54] PACKAGING MACHINE

[75] Inventors: Tadaaki Kume; Yoshihiro Saijo; Yasuji Fujikawa, all of Tokushima, Japan

[73] Assignee: Shikoku Kakoki Co., Ltd., Tokushima, Japan

[21] Appl. No.: 163,588

[22] Filed: Mar. 3, 1988

[30] Foreign Application Priority Data

Mar. 4, 1987 [JP] Japan ..... 62-32414[U]

[51] Int. Cl.[4] ..... B31B 1/64

[52] U.S. Cl. ..... 493/133; 493/164; 493/183

[58] Field of Search ..... 493/127, 133, 136, 137, 493/139, 156, 165, 183, 184, 471, 473, 164; 206/621.1, 631.3; 229/104, 125.42, 138, 138, 139, 140

[56] References Cited

U.S. PATENT DOCUMENTS 2,563,619 8/1951 Ringler ..... 229/140
2,996,233 8/1961 Craig et al. ..... 229/104
3,303,761 2/1967 Monroe et al. ..... 493/183
3,422,730 1/1969 Mitzelfelt et al. ..... 493/164
3,971,300 7/1976 Bachner ..... 493/133

FOREIGN PATENT DOCUMENTS 0511330 8/1939 United Kingdom ..... 229/125.42

*Primary Examiner*—Frederick R. Schmidt
*Assistant Examiner*—Robert Showalter
*Attorney, Agent, or Firm*—Armstrong, Nikaido, Marmelstein, Kubovcik & Murray

[57] ABSTRACT

A packaging machine for preparing sealed containers filled with contents each from a blank having a thermoplastic synthetic resin layer over each surface thereof. The container is recessed in the central portion of its bottom so as to seat stably. A bottom forming end portion of the blank fitted around a mandrel is folded flat and then pressed against the forward end surface of the mandrel by a press member with its press face to form the bottom of the container. The mandrel end surface defines a cavity for recessing the bottom central portion, and a projection complementary to the cavity is provided on the press face of the press member.

2 Claims, 5 Drawing Sheets

PACKAGING MACHINE

BACKGROUND OF THE INVENTION

The present invention relates to a packaging machine for preparing paper containers filled with contents such as flowable foods.

Such packaging machines are adapted to close one end of a tubular container blank by folding and pressure bonding for the closed end to serve as the container bottom. The bottom thus formed, although generally flat, slightly bulges outward owing to the resiliency or the like of the blank, so that the container does not seat well. Accordingly, such containers can not be placed with good stability on display.

SUMMARY OF THE INVENTION

The present invention provides a packaging machine for preparing sealed containers filled with contents each from a blank in the form of a tube of rectangular cross section and having a thermoplastic resin layer over each of its inner and outer surfaces, each of the containers being recessed in the center of its bottom so as to seat stably, the packaging machine comprising a machine bed having a plurality of processing stations including a heating station, a folding station and a pressure bonding station; an intermittently movable rotor having radial mandrels equal in number to the number of the processing stations and each adapted to support the tubular blank as fitted therearound with its bottom forming end portion projecting therefrom, each of the mandrels being stoppable at each of the processing stations while traveling from station to station, the mandrel having a forward end surface defining a cavity for recessing the bottom central portion of the container; a heater disposed at the heating station for heating said end portion of the blank; a folding unit provided at the folding station for folding the heated end portion flat; and a pressure bonding unit provided at the pressure bonding station and cooperative with the mandrel for bonding the folded end portion under pressure, the pressure bonding unit comprising a press member, the press member having a press face for pressing the folded end portion of the blank against the end surface of the mandrel when the mandrel having the blank fitted therearound is at rest at the bonding station, the press face having a projection complementary to the cavity of the mandrel.

According to the present invention, the forward end face of each mandrel defines a cavity which is complementary to a projection provided on the press face of the press member, so that the end portion of the blank to be made into the bottom of a container can be pressure-bonded as recessed at its center. The containers produced by the packaging machine therefore seat with good stability.

DESCRIPTION OF THE PREFERRED EMBODIMENT

An embodiment of the invention will be described below with reference to the drawings.

Figure 5:
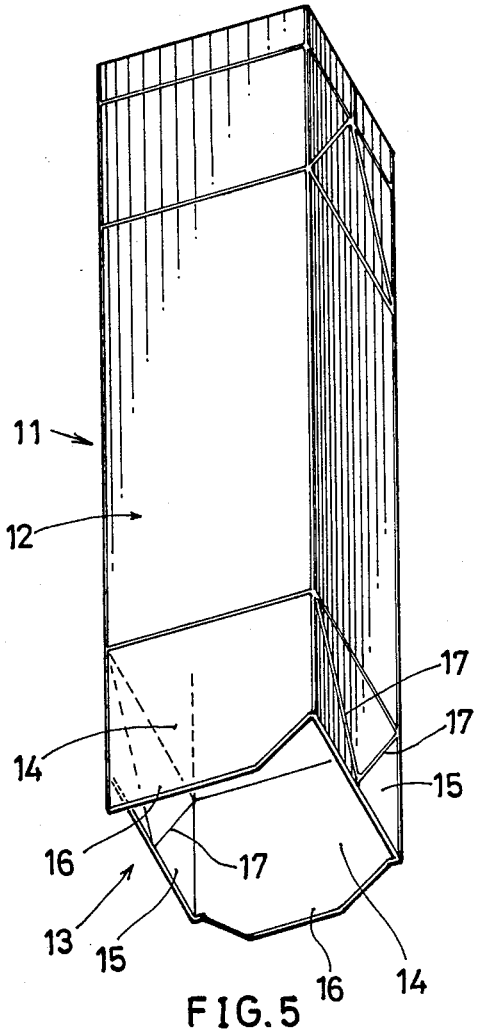
FIG. 5 is a perspective view of a container blank useful for the packaging machine of the invention.

Before describing the packaging machine, the blank to be made into a container by the machine will be described first. With reference to FIG. 5, the container blank 11 comprises a trunk 12 of rectangular cross section and a portion 13 integral with the lower end of the trunk 12 for forming a bottom. The portion 13 comprises a pair of outer bottom panel 14 integral with the trunk 12 at the long sides of its rectangular cross section, and a pair of inner bottom panels 15 integral with the trunk at the short sides of the cross section. Each outer bottom panel 14 has an extension 16 projecting downward beyond the inner bottom panel 15. A V-shaped score 17 is formed in the inner bottom panel 15.

Figure 6:
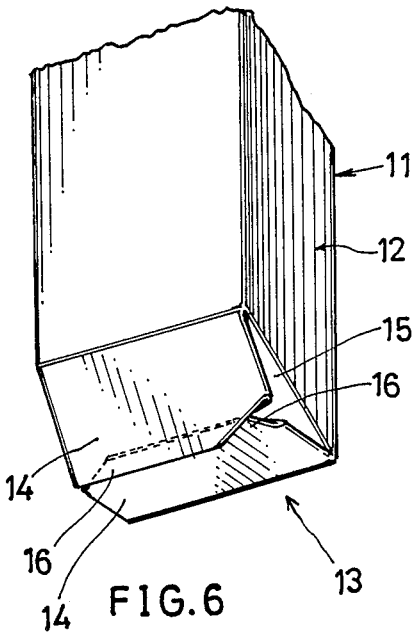
FIG. 6 is a perspective view for illustrating how to fold the bottom forming end portion of the blank.

With reference to FIG. 6, the bottom of the container is formed by bending the inner bottom panels 15 inward along the V-shaped scores 17, folding the outer bottom panels 14 over the inner bottom panels 15, inserting one of the extensions 16 of the two outer bottom panels 14 between the other extension 16 and the inner bottom panels 15 thereunder, and heat-sealing the contact portions of the panels.

Figure 1:
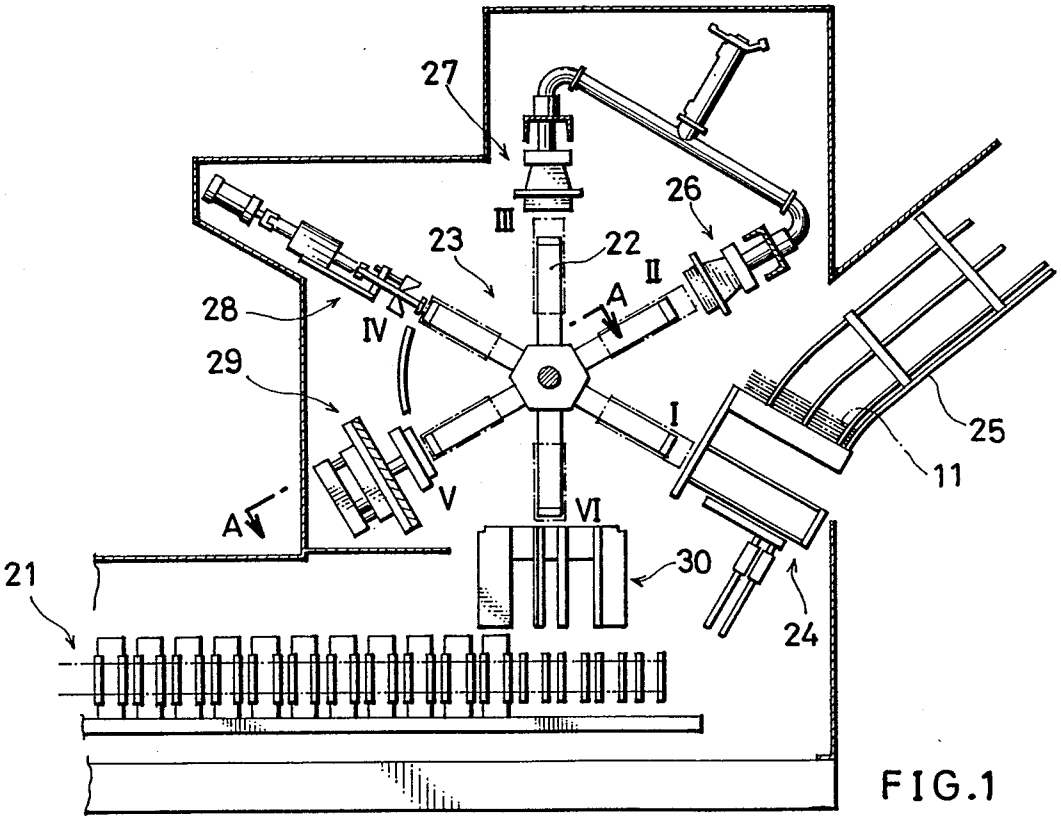
FIG. 1 is a side elevation of a packaging machine.

With reference to FIG. 1, the packaging machine comprises two rotors 23 each having six radial mandrels 22 and disposed side by side above the starting end of the path of travel of a container conveyor 21. Since the two rotors 23 have the same construction and operate in the same manner, the packaging machine will be described with respect to only one of the rotors 23. The rotor 23 is intermittently driven by unillustrated means so that each of the mandrels 22 stops at six stations, i.e. first to sixth processing stations I to VI, while traveling from station to station. Of these processing stations I to VI, the sixth station VI is so positioned that the mandrel 22 is stopped as oriented vertically downward. The first to sixth stations I to VI are arranged along the direction of rotation of the rotor 23 (counterclockwise in FIG. 1). The first station I is provided with a blank feeder 24. The feeder has a magazine 25 having accommodated therein a stack of container blanks 11 which are folded flat and each shapable into a tube of rectangular cross section. The blank 11 is delivered from the magazine 25 by the feeder 24 while being unfolded into a tube of rectangular cross section, and fitted around a mandrel 22 at rest at the first processing station I with the bottom forming end portion 13 of the blank 11 projecting from the mandrel 22. Primary and secondary heaters 26 and 27 for successively heating the end portion 13 of the blank 11 are arranged at the second and third processing stations II and III, respectively. Respectively arranged at the subsequent fourth and fifth processing stations IV and V are a blank end folding unit 28 for folding the end portion 13 flat and a pressure bonding unit 29 for bonding the folded end portion 13 under pressure to obtain a tubular container having the closed bottom portion 13. The terminal sixth station VI is provided with a container transfer unit 30 for transferring the container from the mandrel 22 to the conveyor 21.

The foregoing components or units other than the mandrels 22 and the pressure bonding unit 29 are known and will not be described in detail.

Figure 2:
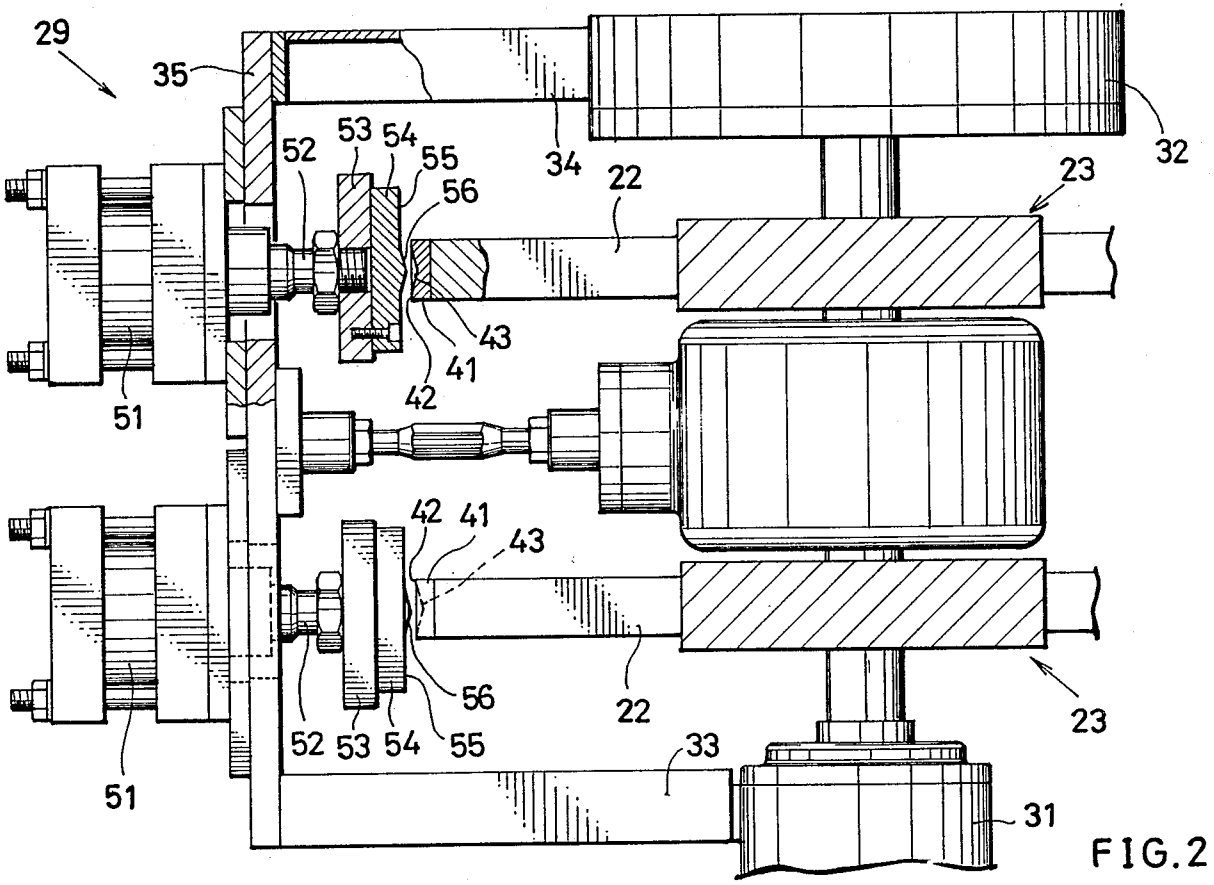
FIG. 2 is a view in section taken along the line A—A in FIG. 1.

With reference to FIG. 2, bearings 31 and 32 for each rotor 23 are mounted on a pair of support arms 33 and 34, respectively, which are parallel to each other. The forward ends of the arms 33, 34 extend to positions at opposite sides of the pressure bonding unit 29, which is mounted on a support plate 35 connected between the forward ends.

Figure 3:
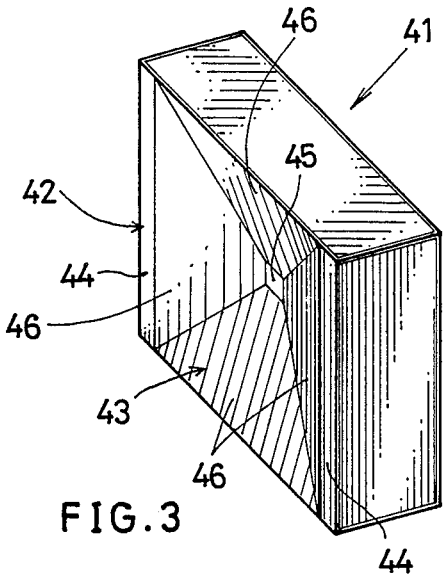
FIG. 3 is a perspective view showing the forward end surface of a mandrel.

The mandrel 22 has attached to its forward end a mandrel cap 41 which, as seen in FIG. 3, has an end surface 42 conforming to the shape of the bottom inner surface of the container. The end surface 42 except for elongated rectangular side portions 44 defines a cavity 43. The surface defining the cavity 43 is substantially pyramidal and comprises a flat square bottom face 45 and four slanting trapezoidal faces 46 extending upward from the bottom face 45. The cavity 43 has a depth of 3 to 5 mm.

Figure 4:
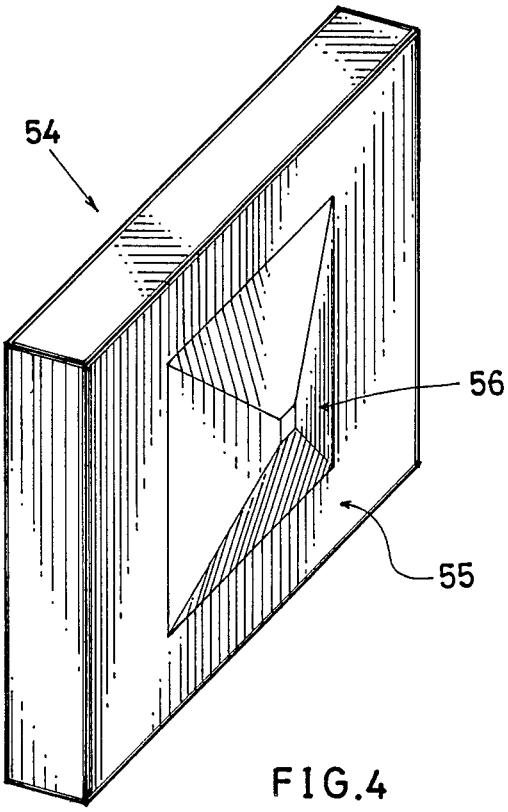
FIG. 4 is a perspective view showing the press face of a press member.

The pressure bonding unit 29 comprises a hydraulic cylinder 51 having a rod 52 and attached to, and oriented inwardly of, the support plate 35, the cylinder 51 being in alignment with, and positioned outwardly of, the mandrel 22 when the mandrel 22 is at rest at the fifth processing station V. The unit 29 further comprises a press member 54 attached to the rod 52 by a mount member 53. With reference to FIG. 4, the press member 54 is generally in the form of a flat plate and has a press face 55 opposed to the end surface 42 of the mandrel and formed with a projection 56 at its central portion. The projection 56 is substantially pyramidal and complementary to the cavity 43.

Figure 7:
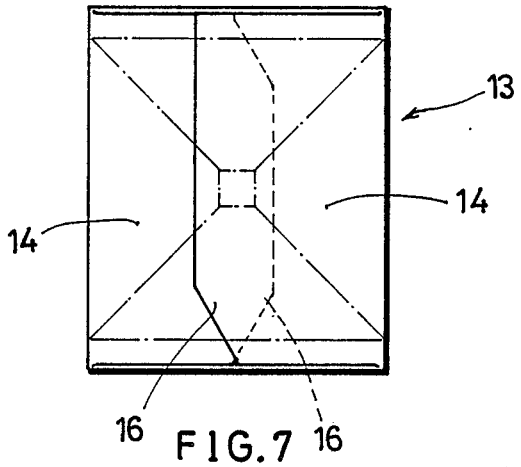
FIG. 7 is a bottom view of a container.
Figure 8:
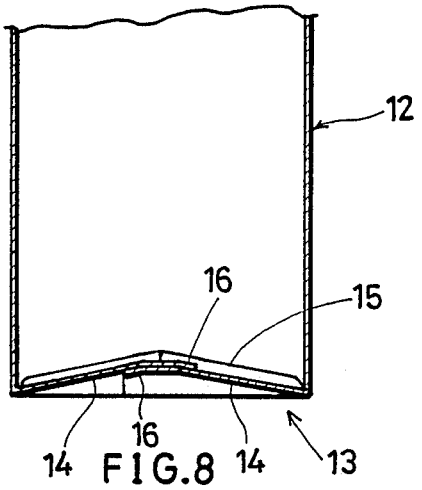
FIG. 8 is a sectional view of the bottom of the container.

With reference to FIG. 7, when the press member 54 is pressed against the end portion 13, folded flat, of the container blank 11 fitted around the mandrel 22, the end portion 13 is bonded by the pressure as held in a centrally recessed form conforming to the shape of the mandrel cavity 43 and the press member projection 56. The end portion 13 thus pressure-bonded thereafter retains the centrally recessed form as seen in FIG. 8 to serve as the bottom of the container.

What is claimed is:

1. A packaging machine for preparing sealed containers to be filled with contents with each container formed from a tubular blank having a rectangular cross section and a thermoplastic synthetic resin layer over each of its inner and outer surfaces each of the containers being recessed in the center of its bottom so as to seat stably, the packaging machine comprising:

a machine bed having a plurality of processing stations including a heating station, a folding station and a pressure bonding station, an intermittently movable rotor having radial mandrels equal in number to the number of the processing stations and each adapted to support a tubular blank fitted therearound with its bottom forming end portion projecting therefrom, each of the mandrels being stoppable at each of the processing stations while traveling from station to station, each mandrel having a forward end surface defining a substantially pyramidal cavity for recessing the bottom central portion of the container, a heater disposed at the heating station for heating said bottom forming end portion of the blank, a folding unit provided at the folding station for folding the heated end portion of the blank flat, and a pressure bonding unit provided at the pressure bonding station and cooperative with the mandrel for bonding the folded end portion of the blank under pressure, the pressure bonding unit comprising a press member, the press member having a press face for pressing the folded end portion of the blank against the forward end surface of the mandrel when the mandrel having the blank fitted therearound is at rest at the bonding station and the press face having a projection complementary to the cavity of the mandrel.

2. A packaging machine as defined in claim 1 wherein the cavity has a depth of 3 to 5 mm.

* * * * *